US005230468A

United States Patent [19]

Koponen et al.

[11] Patent Number: 5,230,468

[45] Date of Patent: Jul. 27, 1993

[54] COMBINATION OF CASSETTES FOR INSULATION OF RADIATORS

[76] Inventors: Tauno K. Koponen; Laila T. Koponen, both of Engelbrektsgatan 13 A 4 tr, S-21133 Malmö , Sweden

[21] Appl. No.: 686,995

[22] Filed: Apr. 18, 1991

[30] Foreign Application Priority Data

Apr. 23, 1990 [SE] Sweden ..... 9001433

[51] Int. Cl.[5] ..... F24D 19/06

[52] U.S. Cl. ..... 237/79

[58] Field of Search ..... 237/79, 70, 73, 78 A; 165/130, 131

[56] References Cited

U.S. PATENT DOCUMENTS 1,174,626 3/1916 Shipp ..... 237/79

*Primary Examiner*—Henry A. Bennett

*Attorney, Agent, or Firm*—Larson & Taylor

[57] ABSTRACT

A combination of cassettes for insulation of radiator front faces without reducing the radiator heating effect. The combination of cassettes is constructed so that the metal plates fastened between the cavities (3) of cover (2) are folded so that lap (13) at the upper end of the side edge lifts the metal plate (1) upper edge against the sides (17) of cover (2) and lap (8) in the lower side edge restricts the distance between metal plate (1) lower edge and the cover (2) whilst the tongue (9) presses by spring force the side edges of the metal plates tight into the cavity (3) and the flap (5) in the metal plate (1) lower edge regulates the minimum distance between cover (2) and the center of the metal plate (1) and the opposite flap (6) regulates the distance between the upper edge of the lower metal plate (1) and the lower edge of the upper metal plate (1).

7 Claims, 6 Drawing Sheets

COMBINATION OF CASSETTES FOR INSULATION OF RADIATORS

This invention relates to a combination of cassettes for insulation of radiators by means of which the radiator front side is insulated without reducing the heating effect of the radiator and by means of which the radiator front face is covered.

All known and by different methods heated radiators have the disadvantage to limit room decoration because of high front temperature and to cause skin damages in the house. Generally, much more expensive and space-taking heating systems are often chosen under the pretest that radiator disadvantages are unpleasant. By means of larger radiators or installation of thermostate-controlled switches on electric radiators, existing disadvantages have not been remedied and protective insulation in front of a radiator reduces the heating effect and is not applicable for industrial production.

The aim of the invention is to provide a combination of cassettes fit for serial production, which insulates radiator front face without reducing the radiator heating effect.

In order to accomplish these aims, the invention contains the elements set forth in the following patent claims.

With reference to the enclosed drawings, a description of the embodiment of the invention is given below.

Figure 11:
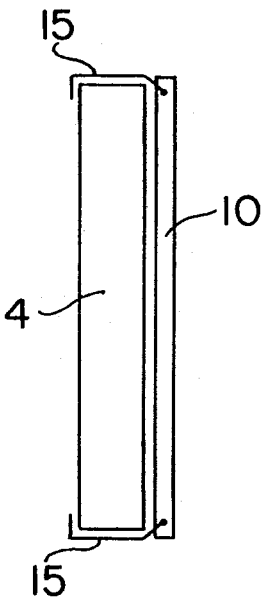
FIG. 11 is a combination of cassettes according to the invention fixed on a radiator viewed from the side.
Figure 10:
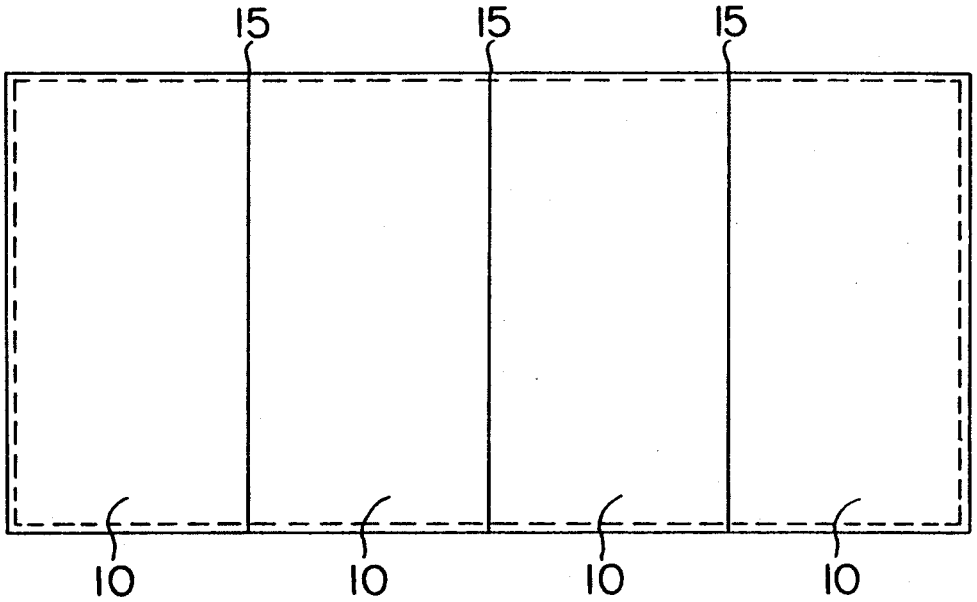
FIG. 10 is the front of a combination of cassettes according to the invention.
Figure 12:
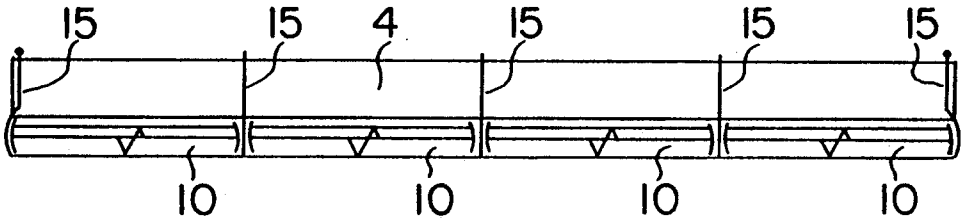
FIG. 12 is a combination of cassettes according to the invention fixed on a radiator viewed from above.

According to FIGS. 1-5 a cassette (10) in the combination of cassettes contains a cassette cover (2) with metal plates (1) between the cavities (3) at its ends. Flaps (5 and 6) restrict the bending of metal plate (1) against cassette cover (2) when the metal plate is heated by the radiator (4). Flaps (5 and 6) also cause turbulence and increase thereby heat transmission of through-streaming air current (11) and the minimum distance between the metal plate (1) edges (7) is regulated by flap (6). Flaps (5 and 6) tapers the metal plate (1) and regulates thereby the bending line for the metal plate (1). Lap (8) on the metal plate (1) lower edge regulates the distance between cover (2) and metal plate (1) lower edge. Tongue (9) pushes by spring-force the edges (7) apart and fastens the lower edge on the lower metal plate (1) keeping the air inlet totally open. Lap (13) on the upper edge of metal plate (1) regulates the distance between the sides (17) of the cover (2) and the upper edge of metal plate (1) and restricts the depth of the double gap at the metal plate (1). The tongues (14) at the top and the bottom end of cover (2) are folded in order to avoid metal plate (1) sliding off the cavity in cover (2). Holes (16) on cover (2) enable assembly of cassettes to a proper combination for the radiator size and fitting of consoles (15). According to FIGS. 10, 11 and 12 the radiator (4) is insulated with a combination of four cassettes wherein the refraction of heat takes place on metal plates (1) and leaves the covers to the influence of room temperatures.

Figure 1:
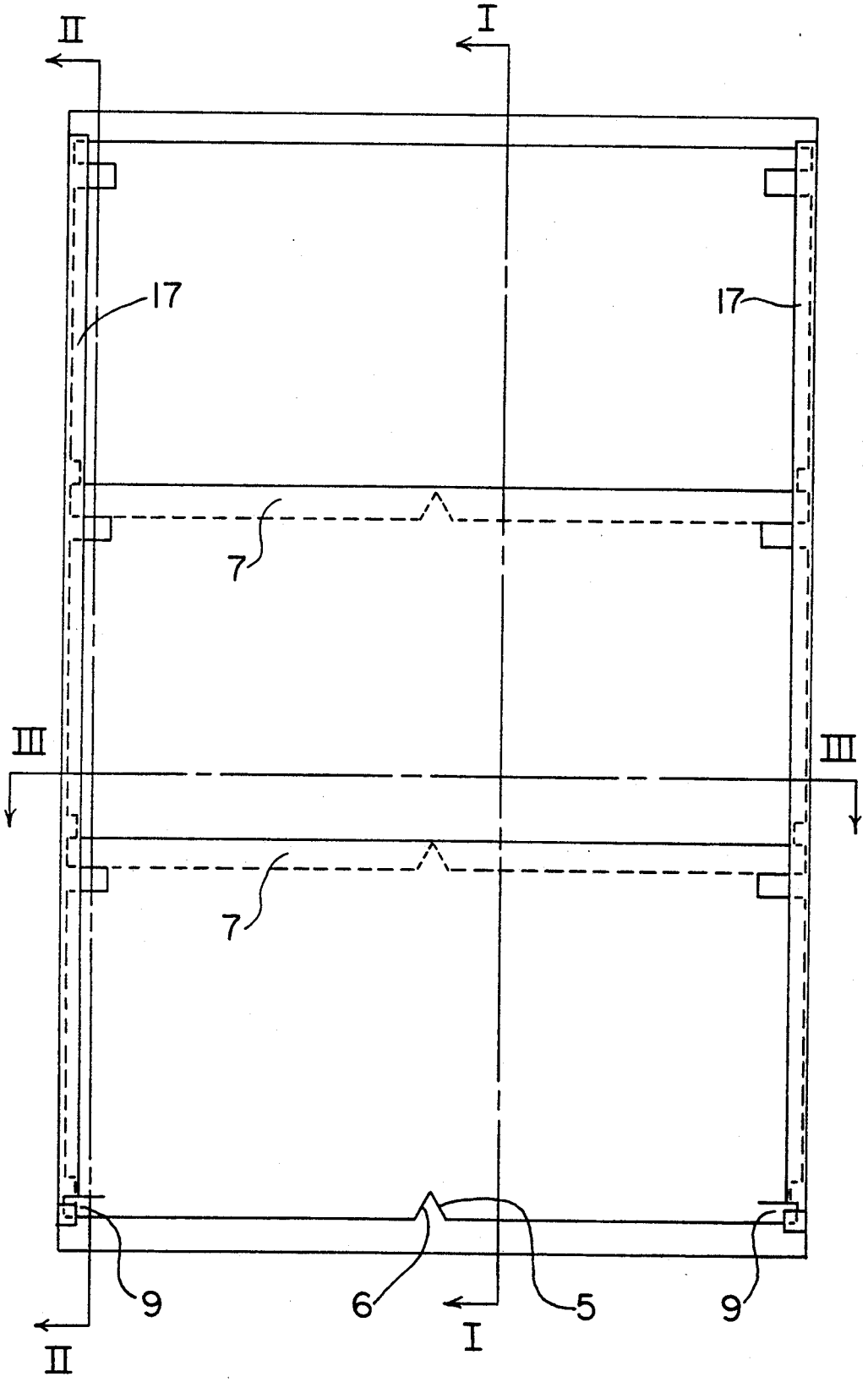
FIG. 1 is the back side of the combination of cassettes according to the invention.
Figure 2:
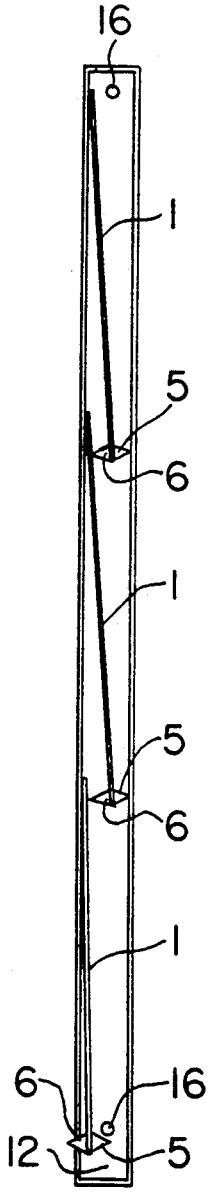
FIG. 2 is a cross-section on line I—I in FIG. 1.
Figure 3:
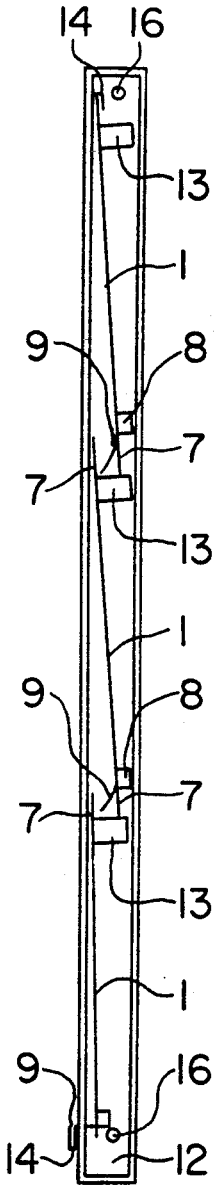
FIG. 3 is a cross-section on line II—II in FIG. 1.
Figure 4:
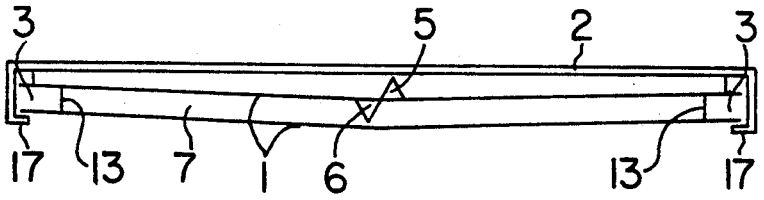
FIG. 4 is a cross-section on line III—III in FIG. 1.
Figure 5:
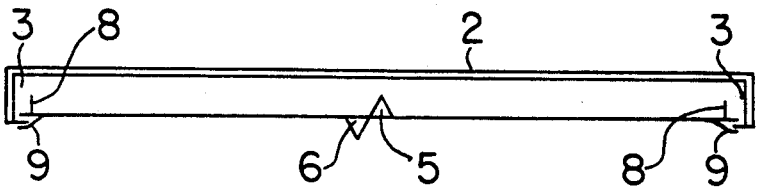
FIG. 5 is a cross-section on line IV—IV in FIG. 1.
Figure 7:
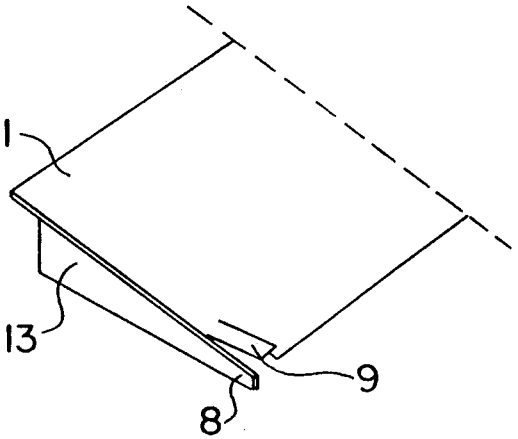
FIG. 7 is an alternative end construction of metal the plate in FIG. 1.
Figure 6:
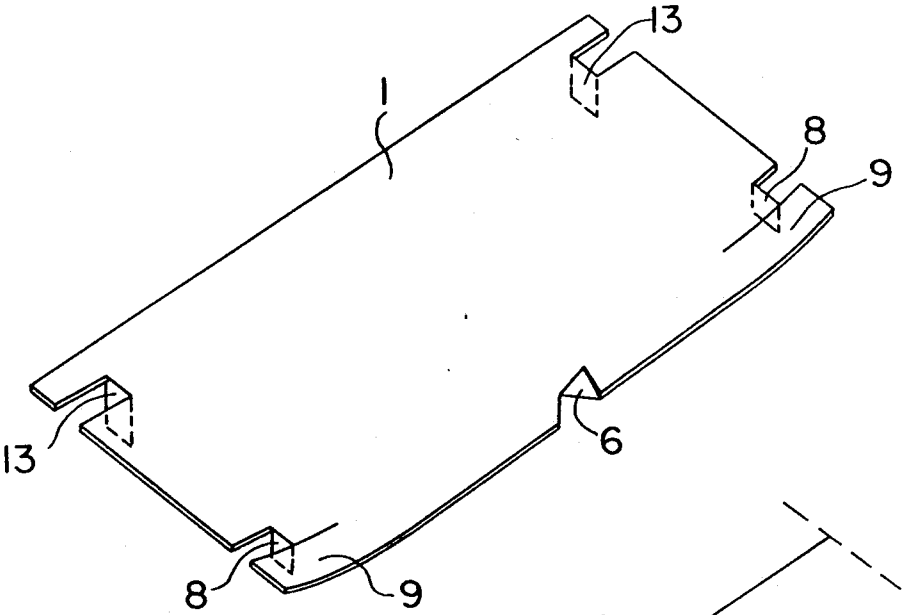
FIG. 6 is a metal plate for cassette inside in FIG. 1.

FIG. 6 shows a further metal plate (1) for a cassette inside in FIG. 1 while FIG. 7 illustrates an alternative end construction for a metal plate (1).

Figure 8:
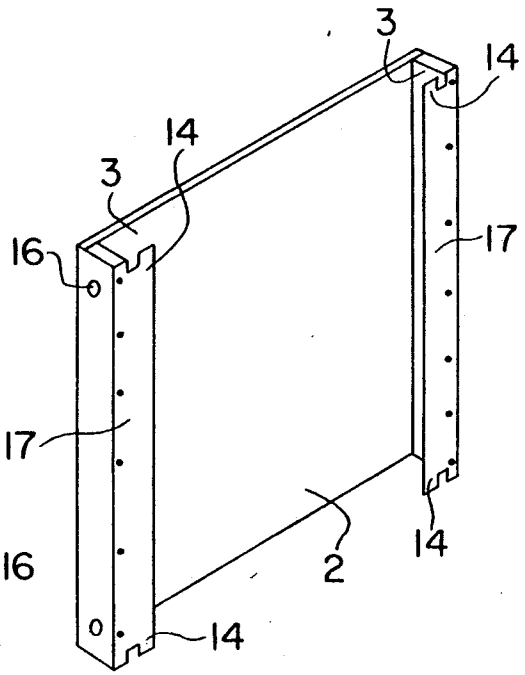
FIG. 8 is an alternative cassette cover plate in FIG. 1.
Figure 9:
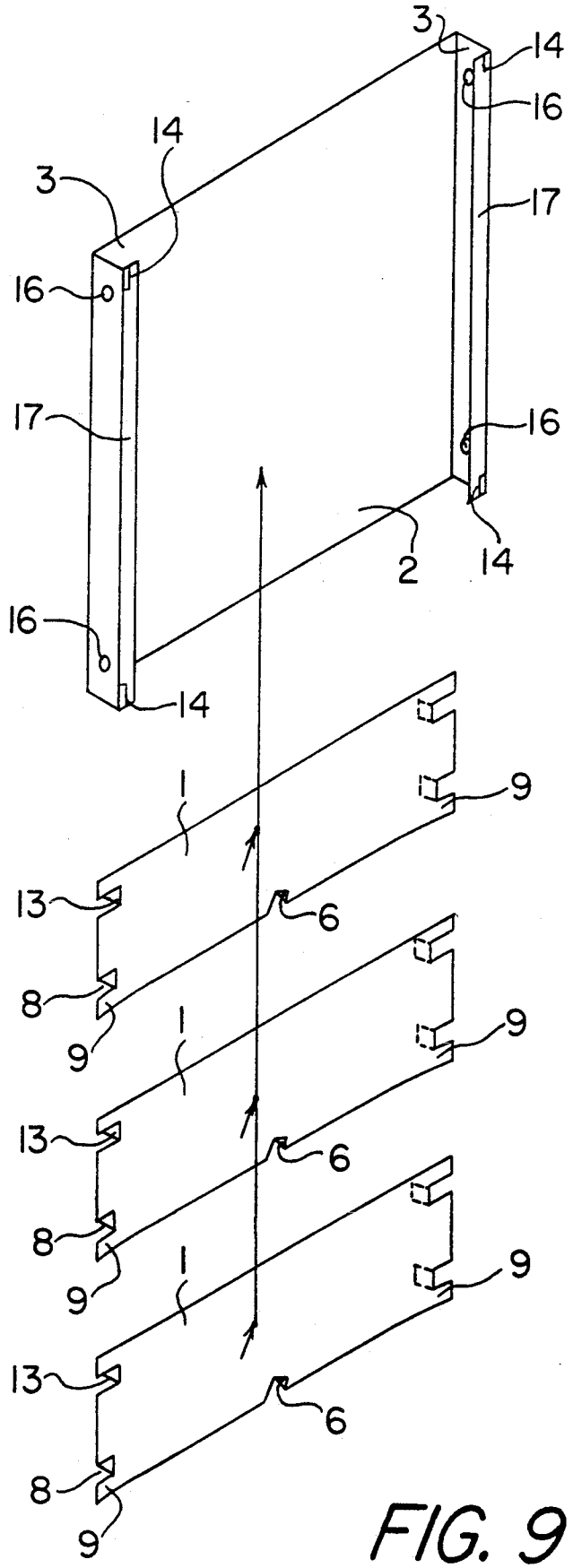
FIG. 9 is a cassette assembly in FIG. 1.

FIG. 8 shows an alternative embodiment of cassette cover plate (2) for use in FIG. 1 and FIG. 9 illustrates a cassette assembly including plates (1) and cover plate (2).

Figure 13:
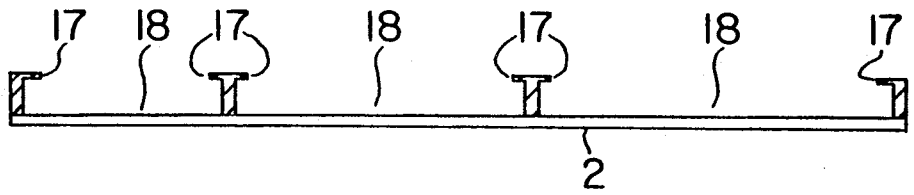
FIG. 13 is the cover construction in FIG. 8 with three metal plate compartments.
Figure 14:
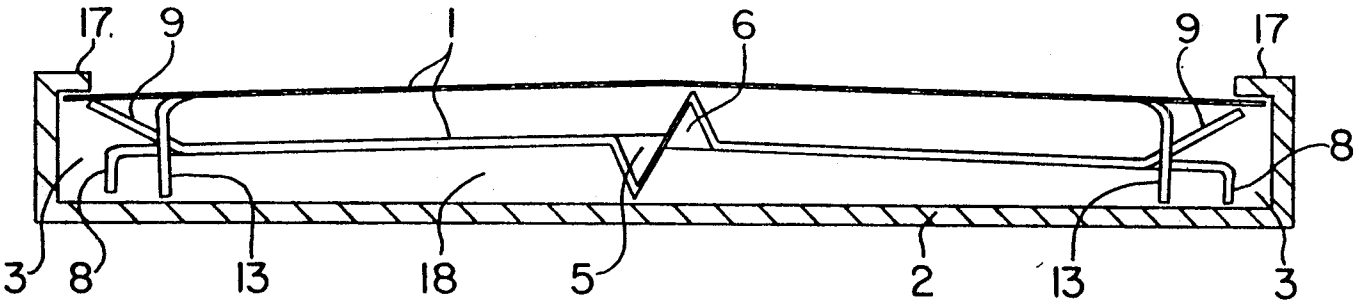
FIG. 14 is a horizontal cross-section of a cassette in the combination of cassettes according to the invention on a heated radiator.
Figure 15:
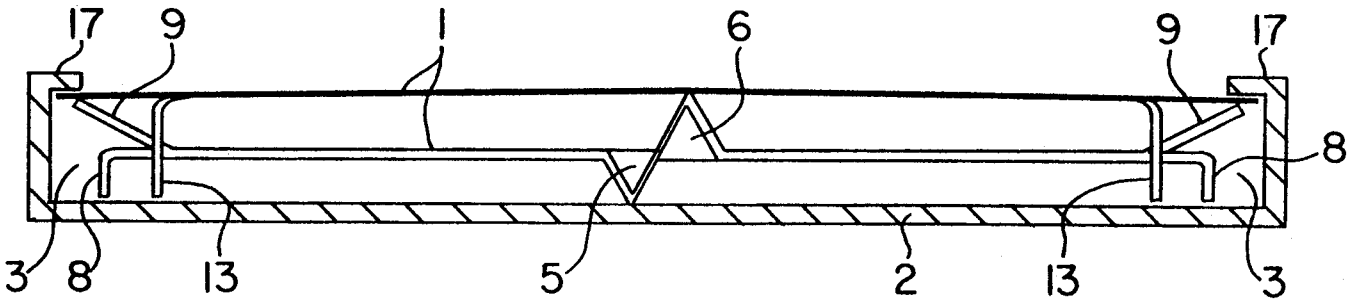
FIG. 15 is a horizontal cross-section of a cassette in the combination of cassettes according to the invention on a cold radiator.

FIG. 13 is a cross sectional view illustrating the cover plate (1) of FIG. 8 but with three metal plate compartments. FIG. 14 is a horizontal cross section of a cassette in accordance with the invention on a heater radiator while FIG. 15 is a similar horizontal cross section of a cassette on a cold radiator.

Within the limits of the invention many variations are possible.

We claim:

1. A cassette combination for insulation of a radiator by assembling cassettes as a covering unit in front of said radiator, wherein each cassette comprises:

a cassette cover;

means, at the top and bottom of said cassette cover, for attaching a cassette to either said radiator or to another cassette;

cavities at the side ends of said cassette cover;

metal plates fastened lengthwise to said cavities;

a first lap, formed in each of said metal plates by folding the upper edge of the metal plate, which lifts the upper edge of the metal plate against the edge of said cassette cover;

a second lap, formed in each of said metal plates by folding the lower edge of the metal plate, which restricts the distance of metal plate from said cassette cover;

a tongue in the lower edge of each metal plate which presses the side end of each metal plate tight against one of said cavities at the cover side end;

a first flap, formed in each of said metal plates by bending the lower edge of the metal plate in a given direction, which determines the minimum distance of the metal plate center part to said cassette cover; and a second flap, formed by in each of said metal plates bending the lower edge of the metal plate in a direction opposite said given direction, which determines the minimum distance of the upper edge of a given metal plate to the lower edge of a metal plate above said given metal plate.

2. Cassette combination according to claim 1 wherein said metal plates are made of aluminium.

3. Cassette combination according to claim 1 wherein said cassette cover is made of aluminium.

4. Cassette combination according to claim 1 characterized in that in the lower edges of the metal plates many flaps are arranged aslant in the air current direction which increase the turbulence that intensifies the heat transmission of air which cools off the metal plates.

5. Cassette combination according to claim 1 wherein said cassette cover with edge contains more than one metal plate sheet.

6. Cassette combination according to claim 1 wherein said cassette cover is made of wood or processed wood material.

7. A cassette combination according to claim 1 wherein said cassette cover is made of plastic.

* * * * *